United States Patent [19]

Hoffman

[11] Patent Number: 4,967,309

[45] Date of Patent: Oct. 30, 1990

[54] DUAL CURRENT SENSING DRIVER CIRCUIT

[75] Inventor: John P. Hoffman, Peoria, Ill.

[73] Assignee: Caterpillar Inc., Peoria, Ill.

[21] Appl. No.: 456,918

[22] Filed: Dec. 26, 1989

[51] Int. Cl.[5] ..... G05F 1/575

[52] U.S. Cl. ..... 361/160; 318/432; 323/287; 361/187

[58] Field of Search ..... 323/287, 288; 361/93, 361/152, 160, 187, 154; 318/687, 135, 678, 432

[56] References Cited

U.S. PATENT DOCUMENTS

| | | | |
|---|---|---|---|
| 3,914,671 | 10/1975 | Morton et al. | 318/139 |
| 3,973,176 | 8/1976 | Rohsler | 318/269 |
| 4,074,175 | 2/1978 | Born et al. | 318/332 |
| 4,446,410 | 5/1984 | Yagura et al. | 318/687 |
| 4,453,194 | 6/1984 | Frankeny et al. | 361/154 |
| 4,645,945 | 2/1987 | de Sartre | 307/254 |
| 4,661,766 | 4/1987 | Hoffman et al. | 323/287 |

FOREIGN PATENT DOCUMENTS 1076888A 2/1984 U.S.S.R. .

OTHER PUBLICATIONS

"Advances in Spacecraft Power Conditioning—New Concepts from Old", (ESA Journal, 1977, vol. 1, No. 4).

*Primary Examiner*—William H. Beha, Jr.

*Attorney, Agent, or Firm*—Stephen L. Noe; Kirk A. Vander Leest

[57] ABSTRACT

A driver circuit for an inductive load, such as a solenoid winding, includes flyback and energization current sensors which respectively sense the current through the coil during flyback and energization. The flyback current sensor includes a flyback current resistor disposed in the flyback current path of the winding for producing a flyback signal proportional to the flyback current. The energization current sensor includes an energization current resistor disposed within the energization current path of the winding. The energization current resistor is adapted to produce an energization signal in response to the energization current flowing through the winding. Control of the solenoid winding is effected by a switch which connects and disconnects the winding from a power source in response to the duty factor of a control signal. A first summing amplifier receives the flyback and energization signals and produces an actual current signal in response to the received signals. A second summing amplifier receives the actual current signal and a desired current signal and produces an error signal in response to a difference between the actual and desired current signals. A first comparator receives the error signal and produces the control signal responsive to the error signal, wherein the duty factor of the control signal is responsive to the magnitude of error signal. The duty factor of the control signal is constantly adjusted in this manner to maintain the solenoid current at the desired level.

5 Claims, 2 Drawing Sheets

DUAL CURRENT SENSING DRIVER CIRCUIT

DESCRIPTION

1. Technical Field

This invention related generally to a driver circuit for controlling the magnitude of current supplied to a winding of an inductive load such as a solenoid, and, more particularly, to a driver circuit which has separate means for sensing the current flowing during energization and flyback.

2. Background Art

In the field of driver circuits, there are many variations in solenoid driver circuitry used in industry today. The majority of these include means for sensing the solenoid current to regulate the current in a closed loop system. In previous solenoid circuitry, a single resistor or other transducer is commonly used to sense the current supplied to the solenoid. In such an arrangement, there are two locations where a single resistor can be located to sense both the current supplied to the solenoid when the driver is "on" and the flyback current when the driver is turned "off". The flyback current is a significant portion of the total current when the driver is used in a pulse width modulated application.

A common location for the single current sensing resistor is in the ground return line intermediate the junction of the flyback diode and the solenoid winding. The advantages of this location are that only a single resistor is required to sense solenoid current and a simple electronic circuit can be used to process the signal. However, there are distinct disadvantages in using a single resistor at this location. For example, if the solenoid return line should short to ground, the current sensing resistor would have zero voltage drop across it, just as if no current were flowing through the solenoid coil. If this circuit were used in a closed loop system, the fault could cause the control to produce maximum current in an effort to obtain the desired current. The solenoid would turn fully "on" and move the controlled element to an extreme position which would be an unacceptable failure mode for systems controlling large forces such as hydraulic cylinders and engine controls. Conversely, if the solenoid return line is shorted to battery voltage considerable power must be dissipated by the sensing resistor. In a typical system, the power rating of the resistor required would require that it be costly as well as physically large and both of these characteristics are undesirable in electronic controls. A smaller power resistor would quickly burn out, thus disabling the control. Owing to the difficulty in repairing board mounted components in the field, the resulting loss in production as well as the cost of the control make this an undesirable condition.

A second location for the single sensing resistor is in the driver output line intermediate the unction of the cathode of the flyback diode and the winding. There are inherent disadvantages associated with locating the current sensing resistor at the second location. When the driver circuit is turned "on", the circuit must sense a voltage drop of typically 1 volt, within a 1% tolerance, where the common mode voltage is within one or two volts of the relatively high supply voltage. When the solenoid turns "off", the output voltage will be near zero and a negative voltage will be created across the resistor as a result of the flyback current through the diode. The sensing circuitry must be able to respond to this changing condition and yet maintain the desired accuracy. The complexity of the circuitry required to accurately respond to the variable reference voltage drop results in an unduly expensive driver circuit.

An improved driver circuit for an inductive load, such as a solenoid, is disclosed in U.S. Pat. No. 4,661,766, hereinafter referred to as '766, which issued to Hoffman et al. on Apr. 28, 1987. In the '766 driver circuit, separate means are provided for sensing the current flowing during energization and flyback. More particularly, the inductive load has a reverse biased flyback diode connected in parallel with an inductive winding of a solenoid. The drive circuit includes a switching means which respectively connects and disconnects the inductive load to and from the source in response to receiving first and second control signals. A first means senses the current flowing only through the flyback diode and delivers a signal which has a magnitude responsive to the magnitude of the flyback current. A second means senses the current flowing only through the switching means and delivers a signal having a magnitude proportional to the magnitude of the switching means current. A means receives the flyback and switching current signals and delivers the first and second control signals to the switching means at a preselected frequency and variable duty factor. The duty factor is responsive to the magnitude of the flyback and switching current signals.

In the '766 circuit, the second switching means includes a current sensing resistor connected between a positive reference of the source of electrical potential and the switching means. The second switching means further includes a current mirror which has a pair of pnp transistors. The current flowing through the current sensing resistor is sensed by the current mirror and the current mirror ideally produces an output current which has a magnitude responsive to the magnitude of the current flowing through the current sensing resistor. Nevertheless, the signal produced by the current mirror can be erroneous if the two transistors are not correctly matched. If improved accuracy of the system is desired, the specifications of the transistors must be more closely matched. However, it is difficult and costly to exactly match the current mirror transistors. Therefore, a driver circuit which eliminates the need for a current mirror is highly desirable.

The present invention is directed to overcoming one or more of the problems as set forth above, while providing a driver circuit which does not require a matched transistor pair connected as a current mirror.

DISCLOSURE OF THE INVENTION

In accordance with one aspect of the present invention, there is provided a driver circuit for controllably connecting an inductive load to a source of electrical power. The inductive load has a reverse biased flyback diode connected in parallel with an inductive winding of a solenoid. The driver circuit includes a switch which connects and disconnects the inductive load to and from the source in response to receiving a control signal. A flyback sensor senses the current flowing through the flyback diode and delivers a flyback signal having a magnitude responsive to the magnitude of the flyback current. An energization current resistor is connected between a positive terminal of the electrical power source and the switch. An operational amplifier has a non-inverting input terminal connected to the junction of the energization current resistor and the switch, an inverting input terminal, and an output terminal. A scaling resistor is connected to the junction of the source of electrical potential positive terminal and the operational amplifier inverting input terminal. A p-channel MOSFET has a gate connected to the operational amplifier output terminal and a source connected to the junction of the operational amplifier inverting input terminal and the scaling resistor. The p-channel MOSFET is adapted to deliver a switching signal in response to the current flowing through the switch. A controller receives the flyback and switching signals and delivers the control signal to the switch at a preselected frequency and variable duty factor. The duty factor of the control signal is responsive to the magnitude of the flyback and switching signals.

BEST MODE FOR CARRYING OUT THE INVENTION

Figure 1:
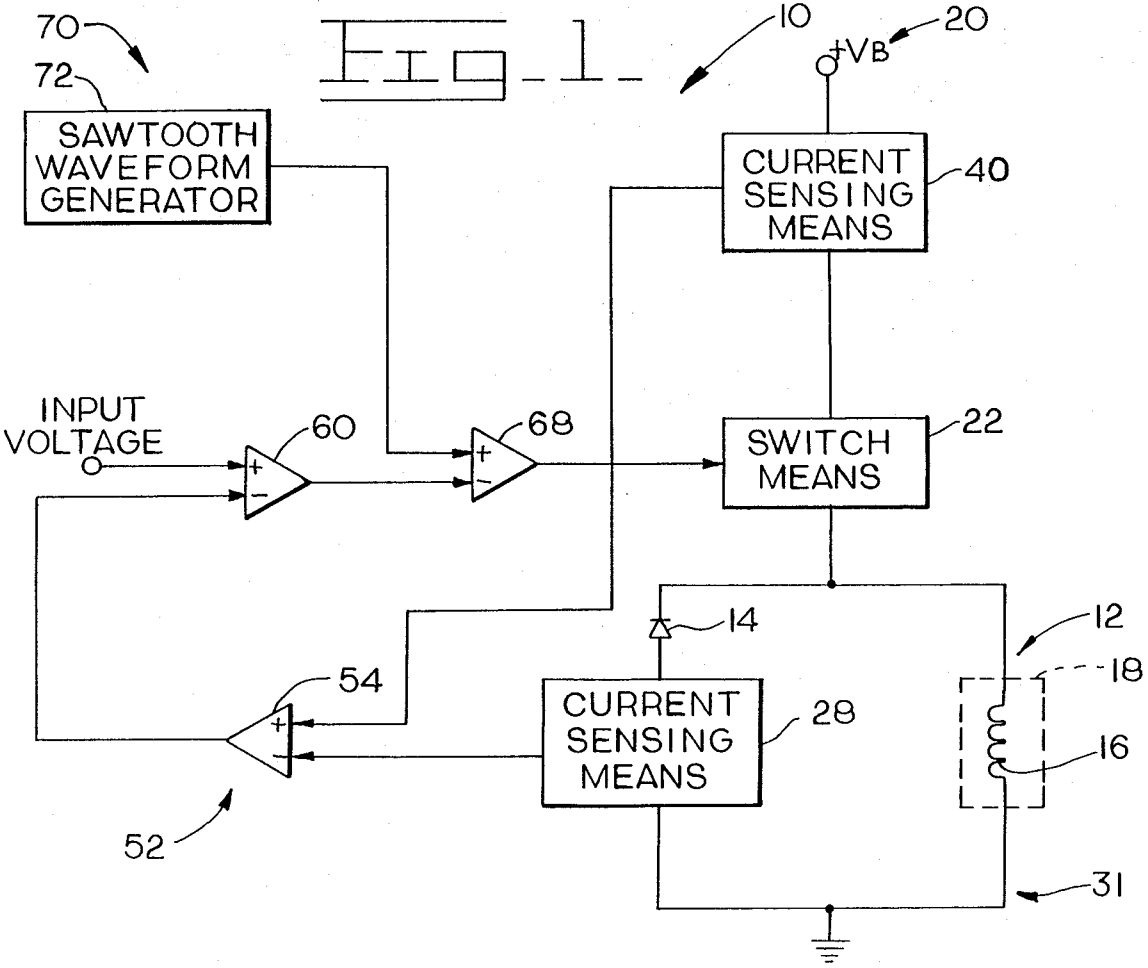
FIG. 1 is a block diagram of an embodiment of the present invention.
Figure 2:
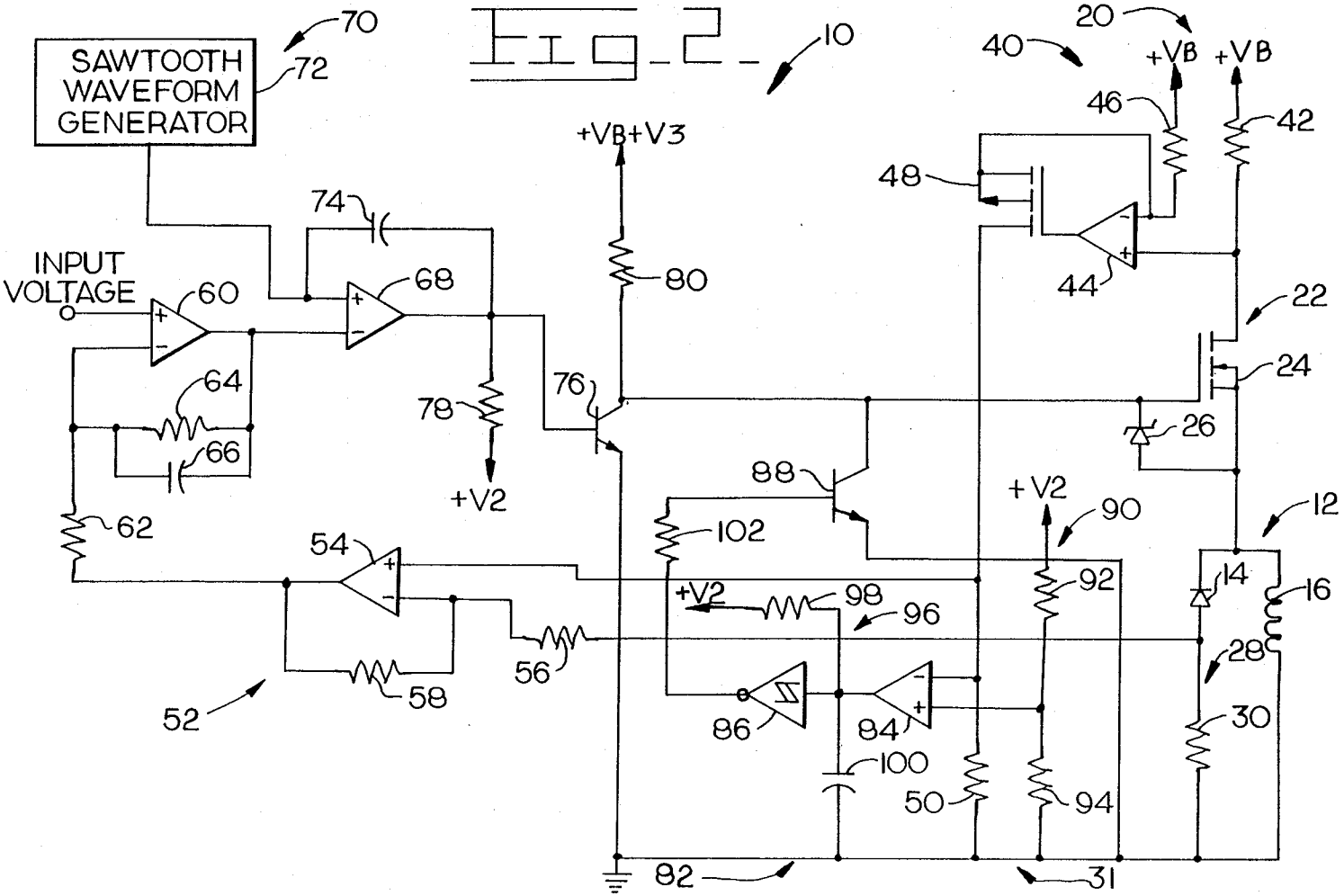
FIG. 2 is a detailed electrical schematic of an embodiment of the present invention.

Referring now to the drawings, a preferred embodiment of the present driver circuit 10 is shown. The driver circuit 10 which controllably connects an inductive load 12 to a terminal 20 of a source of electrical power $V_B$ such as a battery, for example. The inductive load 12 includes a reverse biased flyback diode 14 connected in parallel with an inductive winding 16, or coil, of a solenoid 18. During energization of the winding 16, the flyback diode 14 is reverse biased by a positive voltage from the source $V_B$ and no current flows through the diode 14; however, when the winding 16 is disconnected from the power source positive reference terminal 20, the diode 14 provides a discharge current path to prevent the occurrence of large voltage spikes.

A switching means 22 respectively connects and disconnects the inductive load 12 to and from the power source positive reference terminal 20 in response to receiving a control signal. In the preferred embodiment, the switching means 22 includes an N-channel MOSFET switch 24 having a drain and a source respectively connected to the power source positive reference terminal 20 and the coil 16. A zener diode 26 has its anode connected to the junction of the switching MOSFET and the coil 16 and its source cathode connected to the gate of the MOSFET switch 24. The zener diode 26 prevents the gate-to-source voltage of the MOSFET switch 24 from exceeding a preselected magnitude. The switching means 22 delivers current from the power source $V_B$ to the coil 16, thereby energizing the coil 16, whenever the gate of the MOSFET switch 24 is pulled to a high potential. Conversely, the switching means 22 is turned off when the gate of the MOSFET switch 24 is pulled to a low potential.

A flyback current sensing means 28 senses the current flowing through the flyback diode 14 and produces a flyback signal which has a magnitude responsive to the magnitude of the flyback current. The flyback sensing means 28 includes a flyback current resistor 30 connected between the anode of the flyback diode 14 and a negative terminal 31 of the power source $V_B$. During current flyback, when the MOSFET switch 24 is biased "off", the energy stored in the winding 16 is dissipated through the flyback current resistor 30 and diode 14 in such a manner that the voltage drop across the flyback current resistor 30 is negative relative to the negative reference terminal 31 of the source $V_B$.

An energization current sensing means 40 is provided for sensing the current flowing through the switching means 22 when the coil 16 is being energized. The energization current sensing means 40 includes an energization current resistor 42 connected between the power source positive reference terminal 20 and the drain of the MOSFET switch 24. An operational amplifier 44 has a non-inverting input terminal connected to the junction of the energization current resistor 42 and the switching MOSFET drain. A scaling resistor 46 is connected between the power source positive reference terminal 20 and an inverting input terminal of the operational amplifier 44. A p-channel MOSFET 48 has a source connected to the junction of the scaling resistor 46 and the operational amplifier inverting input terminal. The p-channel MOSFET 48 further has a gate connected to an output terminal of the operational amplifier 44. The drain of the p-channel MOSFET 48 is connected to the power source negative reference terminal 31 through a first resistor 50. The energization current sensing means 40 produces a switching signal in response to the magnitude of the current flowing through the switching means 22 during coil energization.

Selection of the ohmic value of the scaling resistor 46 relative to the ohmic value of the energization current resistor 42 determines the relationship between the current through the switching means 22 and the switching signal produced by the energization current sensing means 40. More specifically, the second current sensing means 40 operates as follows. The energization current passes through the energization current resistor 42, causing a voltage drop across the resistor 42 which is proportional to the energization current flowing through the coil 16. This voltage is delivered to the non-inverting input of the operational amplifier 44. Since both inputs of an operational amplifier must ideally be at the same voltage potential, the voltage drop across the scaling resistor 46 must be the same as that across the energization current resistor 42. Therefore, the current through the scaling resistor 46 must be directly proportional to the energization current. For example, in the preferred embodiment the energization current resistor 42 has a resistive value of 0.301 ohms and the scaling resistor 46 has a resistive value of 301 ohms. Hence, the current through the scaling resistor 46 is directly proportional to the current delivered to the winding 16, but has a magnitude of only 1/1000th that of the energization current. Furthermore, since the input current to an operational amplifier and the gate current of a MOSFET are ideally zero, the entire current through the scaling resistor 46 flows through the p-channel MOSFET 48 causing a voltage drop across the first resistor 50 which is directly proportional to the energization current.

A control means 52 receives the flyback and switching signals and delivers the control signal to the switching means 22 at a preselected frequency and variable duty factor. In the preferred embodiment, the control means includes a first summing amplifier 54 which has a non-inverting input terminal connected to the junction of the p-channel MOSFET drain and the first resistor 50. Thus, the first summing amplifier 54 is adapted to receive the switching signal at its non-inverting input terminal. More specifically, during coil energization, when the MOSFET switch 24 is biased on, a current proportional to the energization current flows from the p-channel MOSFET drain through the first resistor 50, causing a voltage drop across the first resistor 50 which is directly proportional to the energization current. Hence, during energization, the first summing amplifier 54, by virtue of the connection at its non-inverting input terminal, receives the switching signal from the energization current sensing means 40 and produces an actual current signal which has a voltage magnitude responsive to the magnitude of the energization current.

An inverting input terminal of the first summing amplifier 54 is connected through a second resistor 56 to the junction of the flyback diode 14 and the resistor 30. Thus, the first summing amplifier 54 is adapted to receive the flyback signal at its inverting input terminal. A feedback resistor 58 is connected between an output terminal and the inverting input terminal of the first summing amplifier 54. During current flyback, when the MOSFET switch 24 is biased "off", the energy stored in the winding 16 dissipates through the flyback current resistor 30 and the diode 14 causing a voltage drop across the resistor 30 which is negative relative to the power source negative reference terminal 31. The first summing amplifier 54, by virtue of the connection at its negative input terminal, inverts and amplifies the flyback signal from the flyback current sensing means 28 and produces an actual current signal which has positive polarity and a voltage magnitude responsive to the magnitude of the actual flyback current. The location of the flyback current resistor 30 ensures that only the flyback current will impact upon the voltage drop across the resistor 30. Also, since the resistor 30 is not positioned within the energization current path, it will have zero voltage drop during energization of the winding 16.

From the above description, it can be seen that the operation of the flyback and energization current sensing means 28,40 are complementary in nature. More specifically, each can only sense current during the time period when the other is not operating. For example, when the MOSFET switch 24 is biased "off", the flyback current flows through the flyback current resistor 30 and no current flows through the energizing current resistor 42. Thus, when the MOSFET switch 24 is "off", only the flyback signal is delivered to the first summing amplifier 54. Likewise, when the MOSFET switch 24 is biased "on", the energization current flows through the energization current resistor 42 and no current flows through the flyback sensing resistor 30. Therefore, when the MOSFET switch 24 is "on", only the switching signal is delivered to the first summing amplifier 54. Furthermore, while the output of the summing amplifier 54 is truly the sum of the two inputs, since the inputs are never simultaneously operational, the output is simply proportional to the voltage at the individual input terminals.

A second summing amplifier 60 has an inverting input terminal connected to the output terminal of the first summing amplifier 54 through a third resistor 62, and receives the actual current signal from the first summing amplifier 54. The second summing amplifier 60 further has a non-inverting input terminal connected to an external controller (not shown) which supplies a controllable input voltage having a magnitude proportional to a desired excitation current. An output terminal of the second summing amplifier 60 is connected to the junction of the second summing amplifier inverting input terminal and the third resistor 62 through a fourth resistor 64 and a first capacitor 66. The second summing amplifier 60 compares the actual and desired current signals and produces an error signal having a voltage magnitude proportional to a difference between the compared signals multiplied by a gain, plus an offset voltage equal to the controllable input voltage. The gain of the error signal is equal to the ratio of the fourth resistor 64 to the third resistor 62. For example, if the actual and desired current signals are equal, the error signal is equal to the controllable input voltage. A positive error causes the output voltage to decrease below the controllable input voltage and, conversely, a negative error results in an output voltage which is greater than the controllable input voltage.

A first comparator 68 has an inverting input terminal connected to the second summing amplifier output terminal for receiving the error signal. The first comparator 68 also has a non-inverting input terminal connected to a signal generating means 70 for receiving a repeating signal. In the preferred embodiment, the signal generating means 70 is a sawtooth waveform generator 72 which produces a voltage signal which repeatedly varies linearly from a minimum to a maximum and back to the minimum at a preselected frequency. A second capacitor 74 is connected between an output terminal and the non-inverting input terminal of the first comparator 68 to provide AC hysteresis for noise immunity. The first comparator 68 produces the control signal at its output terminal in response to the error and repeating signals. More particularly, the error signal is compared to the repeating signal and the first comparator 68 produces a pulse-width-modulated (PWM) signal having constant frequency and a duty factor responsive to the magnitude of the error signal. For example, in the preferred embodiment if the output of the second summing amplifier 60 is 75% of the maximum value of the repeating signal, which indicates a large error, the output of the first comparator 68 is "high" for 25% of the factor and "low" for 75% of the factor. Conversely, if the error signal is 25% of the maximum value of the repeating signal, which indicates a small error, the output of the first comparator 68 is "high" for 75% of the factor and "low" for 25% of the factor.

A first npn transistor 76 has a base connected to the output terminal of the first comparator 68, a collector connected to the gate of the MOSFET switch 24 and an emitter connected to the power source negative terminal 31. A first pull-up resistor 78 is connected between the junction of the comparator output terminal and the first npn transistor's base and a second source of electrical potential $V_2$. The first pull-up resistor 78 biases the output terminal of the comparator 68 "high" whenever it is not internally pulled "low".

A second pull-up resistor 80 is connected between the junction of the first npn transistor's collector and the gate of the MOSFET switch 24, and a third source of electrical potential $V_B+V_3$. The second pull-up resistor 80 biases the MOSFET switch 24 "on" when the first npn transistor is biased "off". Conversely, when the first npn transistor 76 is biased "on" the gate of the MOSFET switch 24 is pulled "low" thereby biasing the switch 24 "off". As can be seen, the combination of the second pull-up resistor 80 and the first npn transistor 76 inverts the control signal produced by the first comparator 68. More particularly, when the signal from the first comparator 68 is "low", the signal at the gate of the MOSFET switch 24 will be "high" and vice-versa.

A short circuit means 82 is provided for detecting a short circuit condition of the winding 16 by monitoring the current delivered to the winding 16. The short circuit means 82 includes a second comparator 84, an inverter 86, and a second npn transistor 88. The second comparator 84 has an inverting input terminal connected to the junction of the p-channel MOSFET drain and the first resistor 50, and receives the switching signal at its inverting input terminal. If a short circuit occurs while the MOSFET switch 24 is biased "on", the energization current and thus the switching signal will rise rapidly. The second comparator 84 further has a non-inverting input terminal connected to a voltage divider network 90. The voltage divider network 90 includes fifth and sixth resistors 92, 94 serially connected between the second source of electrical potential +V2 and the power source negative terminal 31. The second comparator's non-inverting input terminal is connected to the junction of the fifth and sixth resistors 92,94 such that the non-inverting input terminal is at a constant reference voltage. The ohmic values of the fifth and sixth resistors 92,94 are selected so that the reference voltage at the non-inverting terminal will be greater than the voltage at the inverting input terminal in the absence of a short circuit. Under normal conditions, the second comparator's output terminal is at a "high" potential. However, when a short occurs and the switching signal voltage exceeds the reference voltage, the second comparator 84 produces a "low" potential signal at its output terminal.

The output terminal of the second comparator 84 is connected to an input terminal of the inverter 86 through an R-C network 96. The R-C network 96 includes a seventh resistor 98 connected between the junction of the second comparator 84 and the inverter 86, and the second source of electrical potential $+V_2$. The R-C network 96 further includes a third capacitor 100 connected between the junction of the second comparator 84 and the inverter 86, and the power source negative terminal 31. The values of the seventh resistor 98 and the third capacitor 100 are advantageously selected such that the output of the second comparator 84 can be pulled "low" much quicker than it can be pulled "high". In the preferred embodiment, the ratio of the "pull-up" time to the "pull-down" time is on a magnitude of several thousand. The inverter 86 has an output terminal connected to a base of the second npn transistor 88 through an eighth resistor 102. The second npn transistor 88 has a collector connected to the junction of the first npn transistor's collector and the MOSFET switch gate and an emitter connected to the power source negative terminal 31. During a short circuit, the R-C network causes the MOSFET switch 24 to be biased "off" several thousand times longer than it is biased "on", thereby preventing an excessive energization current.

The short circuit means 82 operates as follows. Under normal conditions the second comparator 84 produces a "high" output signal during solenoid energization, causing the output terminal of the inverter 86 to be "low", which biases the second npn transistor 88 "off". When the second npn transistor 88 is biased "off", the MOSFET switch drain is pulled "high" by the second pull-up resistor 80, thereby biasing the MOSFET switch 24 "on". However, if a short circuit occurs during solenoid energization, the output signal from the second comparator 84 will be "low" causing a "high" output from the inverter 86 which biases the second npn transistor 88 "on". When the second npn transistor 88 is biased "on", the MOSFET switch gate is pulled "low", thereby biasing the MOSFET switch 24 "off". Furthermore, the R-C network 96 is provided to ensure that during a short circuit the MOSFET switch 24 is biased "off" several thousand times longer than it is biased "on", thereby preventing excessive current in the driver circuit 10 and the associated load.

INDUSTRIAL APPLICABILITY

In the overall operation of the driver circuit 10, assume that the solenoid 18 is used to position a spool of an electronically controlled proportional hydraulic valve at a preselected position. The controllable input voltage provides a reference voltage to the second summing amplifier 60 which is indicative of a desired position of the valve's spool. The driver circuit 10 will operate to maintain a current level in the winding 16 within prescribed limits of the desired current.

Initially, no current is flowing in the winding 16; therefore, the actual current signal from the first summing amplifier 54 is zero. The second summing amplifier 60 produces a large error signal in response to a difference between the actual and desired current signals. This error signal ultimately biases the MOSFET switch 24 "on" at a high duty factor, allowing current to flow through the winding 16. The duty factor of the command signal is continually reduced as the current in the winding 16 increases, until such time as the current flowing through the second current sensing means 40 rises to the prescribed reference.

During the "low" portions of the of the duty factor, when the MOSFET switch 24 is biased "off", flyback current flows through the flyback resistor 30 and decays at an exponential rate. As the flyback current decays, the actual current signal decreases, causing the magnitude of the error signal to increase and the duty factor of the command signal to change appropriately.

Other aspects, objects, and advantages of this invention can be obtained from a study of the drawings, the disclosure, and the appended claims.

I claim:

1. A driver circuit for controllably connecting an inductive load to a source of electrical power, said inductive load having a reverse biased flyback diode connected in parallel with an inductive winding of a solenoid, comprising:

switching means for connecting and disconnecting said inductive load to and from said source in response to receiving a control signal;

flyback current sensing means for sensing the current flowing through said flyback diode and delivering a flyback signal having a magnitude responsive to the magnitude of said flyback current;

an energization current resistor connected between a positive reference terminal of said electrical power source and said switching means;

an operational amplifier having a non-inverting input terminal connected to the junction of said energization current resistor and said switching means, an inverting input terminal, and an output terminal;

a scaling resistor connected to between said electrical power source positive terminal and said operational amplifier inverting input terminal;

a p-channel MOSFET having a gate connected to said operational amplifier output terminal and a source connected to the junction of said operational amplifier inverting input terminal and said scaling resistor, said p-channel MOSFET being adapted to deliver a switching signal in response to the current flowing through said switching means;

control means for receiving said flyback and switching signals and delivering said control signal to said switching means at a preselected frequency and variable duty factor, said duty factor being responsive to the magnitude of said flyback and switching signals.

2. An driver circuit as set forth in claim 1, wherein said switching means includes an n-channel MOSFET having a drain connected to said electrical power source positive terminal through said energization current resistor, a source connected to said inductive load, and a gate connected to said control means.

3. An driver circuit as set forth in claim 1, wherein said flyback current sensing means includes a flyback current resistor connected between a negative terminal of said electrical power source and the anode of said flyback diode.

4. The driver circuit as set forth in claim 3, wherein said control means includes:

a first resistor connected between a drain of said p-channel MOSFET and said electrical power source negative terminal;

a first summing amplifier having an inverting input terminal connected to the junction of said flyback diode and said flyback current resistor and being adapted to receive said flyback signal, a non-inverting input terminal connected to the junction of said first resistor and said p-channel MOSFET drain and being adapted to receive said switching signal, and an output terminal adapted to deliver an actual current signal responsive to the the sum of said flyback and switching signals;

a second summing amplifier having an inverting input connected to said first summing amplifier output terminal and being adapted to receive said actual current signal, a non-inverting input terminal adapted to receive a desired current signal, and an output terminal adapted to deliver an error signal responsive to a difference between said actual and desired current signals; and a first comparator having an inverting input connected to said second summing amplifier output terminal and being adapted to receive said error signal, a non-inverting input adapted to receive a repeating signal and an output terminal adapted to deliver said control signal in response to said error and repeating signals.

5. A driver circuit for controllably connecting an inductive load to a source of electrical power, said inductive load having a reverse biased flyback diode connected in parallel with an inductive winding of a solenoid, comprising:

an energization current resistor;

a MOSFET switch having a drain connected to a positive terminal of said source of electrical power through said energization current resistor, a source connected to said inductive load, and a gate, said MOSFET switch being adapted to connect and disconnect said inductive load and said source in response to receiving a control signal at said gate;

an operational amplifier having a non-inverting input terminal connected to the junction of said energization current resistor and said MOSFET switch, an inverting input terminal, and an output terminal;

a scaling resistor connected to the junction of said electrical power source positive terminal and said operational amplifier inverting input terminal;

a p-channel MOSFET having a gate connected to said operational amplifier output terminal, a source connected to the junction of said operational amplifier inverting input terminal and said scaling resistor, and a drain, said p-channel MOSFET being adapted to deliver a switching signal from said drain in response to the current flowing through said MOSFET switch;

a flyback current resistor connected between a negative terminal of said electrical power source and the anode of said flyback diode, said flyback current resistor being adapted to sense the current flowing through said flyback diode and deliver a flyback signal having a magnitude responsive to the magnitude of said flyback current;

a first resistor connected between said p-channel MOSFET drain and said electrical power source negative terminal;

a first summing amplifier having an inverting input terminal connected to the junction of said flyback diode and said flyback current resistor and being adapted to receive said flyback signal, a non-inverting input terminal connected to the junction of said first resistor and said p-channel MOSFET drain and being adapted to receive said switching signal, and an output terminal adapted to deliver an actual current signal responsive to the sum of flyback and switching signals;

a second summing amplifier having a non-inverting input terminal adapted to receive a desired current signal, an inverting input terminal connected to said first summing amplifier output terminal and adapted to receive said actual current signal, and an output terminal adapted to deliver an error signal responsive to a difference between said actual and desired current signals;

signal generator means for producing a repeating signal which repetitively varies at a preselected frequency between first and second thresholds; and a first comparator having an inverting input connected to said second summing amplifier output terminal and being adapted to receive said error signal, a non-inverting input connected to said signal generator means and being adapted to receive said repeating signal, and an output terminal connected to said n-channel MOSFET gate and being adapted to deliver said control signal in response to said error and repeating signals.

* * * * *